United States Patent [19]

Palazzo

[11] Patent Number: 4,927,050

[45] Date of Patent: May 22, 1990

[54] METHOD OF MAKING DOUBLE WALL STORAGE TANK FOR LIQUIDS FROM A METAL TANK HAVING A PATTERNED SURFACE

[76] Inventor: David T. Palazzo, P.O. Box 290676, Tampa, Fla. 33687

[21] Appl. No.: 332,806

[22] Filed: Apr. 3, 1989

Related U.S. Application Data

[60] Continuation-in-part of Ser. No. 194,387, May 16, 1988, Pat. No. 4,817,817, which is a continuation-in-part of Ser. No. 105,890, Oct. 7, 1987, Pat. No. 4,780,997, which is a continuation-in-part of Ser. No. 105,881, Oct. 7, 1987, Pat. No. 4,780,946, and a continuation-in-part of Ser. No. 43,634, Jun. 11, 1987, Pat. No. 4,744,137, which is a division of Ser. No. 884,481, Sep. 11, 1986, abandoned, which is a continuation-in-part of Ser. No. 884,389, Apr. 7, 1987, Pat. No. 4,655,367, which is a continuation-in-part of Ser. No. 818,258, Jan. 13, 1986, Pat. No. 4,644,627, which is a continuation-in-part of Ser. No. 775,140, Sep. 12, 1985, Pat. No. 4,640,439.

[51] Int. Cl.[5] ..... B23D 9/00

[52] U.S. Cl. ..... 220/445; 220/5 A; 29/455.1

[58] Field of Search ..... 220/445, 453, 466, 468, 220/469, 5 A, 455; 29/455.1

[56] References Cited

U.S. PATENT DOCUMENTS

| | | | |
|---|---|---|---|
| 3,415,408 | 12/1968 | Seitz | 220/445 X |
| 4,261,501 | 4/1981 | Watkins et al. | 220/445 X |
| 4,579,617 | 4/1986 | Öberg et al. | 220/446 X |
| 4,640,439 | 2/1987 | Palazzo | 220/445 |
| 4,651,893 | 3/1987 | Mooney | 220/445 |
| 4,655,367 | 4/1987 | Palazzo | 220/445 |
| 4,744,137 | 5/1988 | Palazzo | 220/445 X |
| 4,780,946 | 11/1988 | Palazzo | 220/445 X |
| 4,780,947 | 11/1988 | Palazzo | 220/445 X |
| 4,817,817 | 4/1989 | Palazzo | 220/445 |
| 4,821,915 | 4/1989 | Mayer | 220/445 X |

*Primary Examiner*—Steven M. Pollard

*Attorney, Agent, or Firm*—Pettis & McDonald

[57] ABSTRACT

A double wall storage tank for liquid and a method for manufacturing that tank are disclosed in which an inner tank is formed of metal panels with at least lower portions of the inner tank being formed from patterned metal having a pattern of projections extending outwardly from a base surface on the exterior such portions of that inner tank, with a sheet of imperforate material stretch over the inner tank to separate the inner tank from subsequently applied sheathing material, and a substantially rigid sheath of resin impregnated fibrous material is applied over that inner tank and sheet.

12 Claims, 3 Drawing Sheets

METHOD OF MAKING DOUBLE WALL STORAGE TANK FOR LIQUIDS FROM A METAL TANK HAVING A PATTERNED SURFACE

RELATED APPLICATIONS

This application is a continuation-in-part of application Ser. No. 194,387 filed May 16, 1988 and issued as U.S. Pat. No. 4,817,817, entitled "Double Wall Storage Tank and Method of Making Same" which is a continuation-in-part of application Ser. No. 105,890 filed Oct. 7, 1987, and issued as U.S. Pat. No. 4,780,947, entitled "Method of Making Double Wall Storage Tank with Channeled Spacer Means" and of application Ser. No. 105,881, filed Oct. 7, 1987, and issued as U.S. Pat. No. 4,780,946 entitled "Method of Making Double Wall Storage Tank with Beaded Spacer Means", which were continuations-in-part of application Ser. No. 43,634 filed June 11, 1987, and issued as U.S. Pat. No. 4,744,137, which application is a division of application Ser. No. 884,481 filed Sept. 11, 1986, and now abandoned and was also a continuation-in-part of application Ser. No. 884,389 filed Apr. 7, 1987, which issued as U.S. Pat. No. 4,655,367 entitled "Double Wall Storage Tank for Liquids," which was a continuation-in-part of application Ser. No. 818,258 filed Jan. 13, 1986, now issued as U.S. Pat. No. 4,644,627 entitled "Method of Making Double Wall Storage Tank for Liquids," which was a continuation-in-part of original application Ser. No. 775,140 filed Sept. 12, 1985, now issued as U.S. Pat. No. 4,640,439 entitled "Double Wall Storage Tank and Method of Making Same," all of the above having been filed in the name of David T. Palazzo.

FIELD OF THE INVENTION

This invention relates to tanks for the storage of liquids, and more particularly to double wall tanks for underground storage of liquids.

BACKGROUND OF THE INVENTION

Tanks for the storaqe of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has prompted the search for methods of fabricating relatively inexpensive double wall tanks. This burden has also given impetus to the search for a method of remanufacturing existing single wall tanks into a double wall assembly with means for detecting the presence of any leaks into the space between the two walls.

SUMMARY OF THE INVENTION

In view of the foregoing, it is the object of the present invention to provide an economical method of manufacturing a double wall storage tank from rigid single wall tank. It is a further object of the invention to provide such a method in which at least a portion of the outer wall or sheath of the tank is spaced from the inner tank.

To achieve these and objects that will become readily apparent to those skilled in the art, this invention provides a double wall storage tank and method of making the same in which a substantially rigid inner tank is formed from a metal having a pattern of projections extending outwardly from a base surface on at least one side thereof such that the exterior surfaces of the inner tank includes the projections extending outwardly, a sheet of imperforate material is stretched over the inner tank and the projections to separate the inner tank from subsequently applied sheeting material, and a substantially rigid outer sheath is applied over the inner tank and the sheet, that outer sheath being formed of a material that substantially liquid-tight with the sheath being spaced from the inner tank exterior surface by the sheet supported on the projections to provide a rigid double wall tank.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENTS

Figure 1:
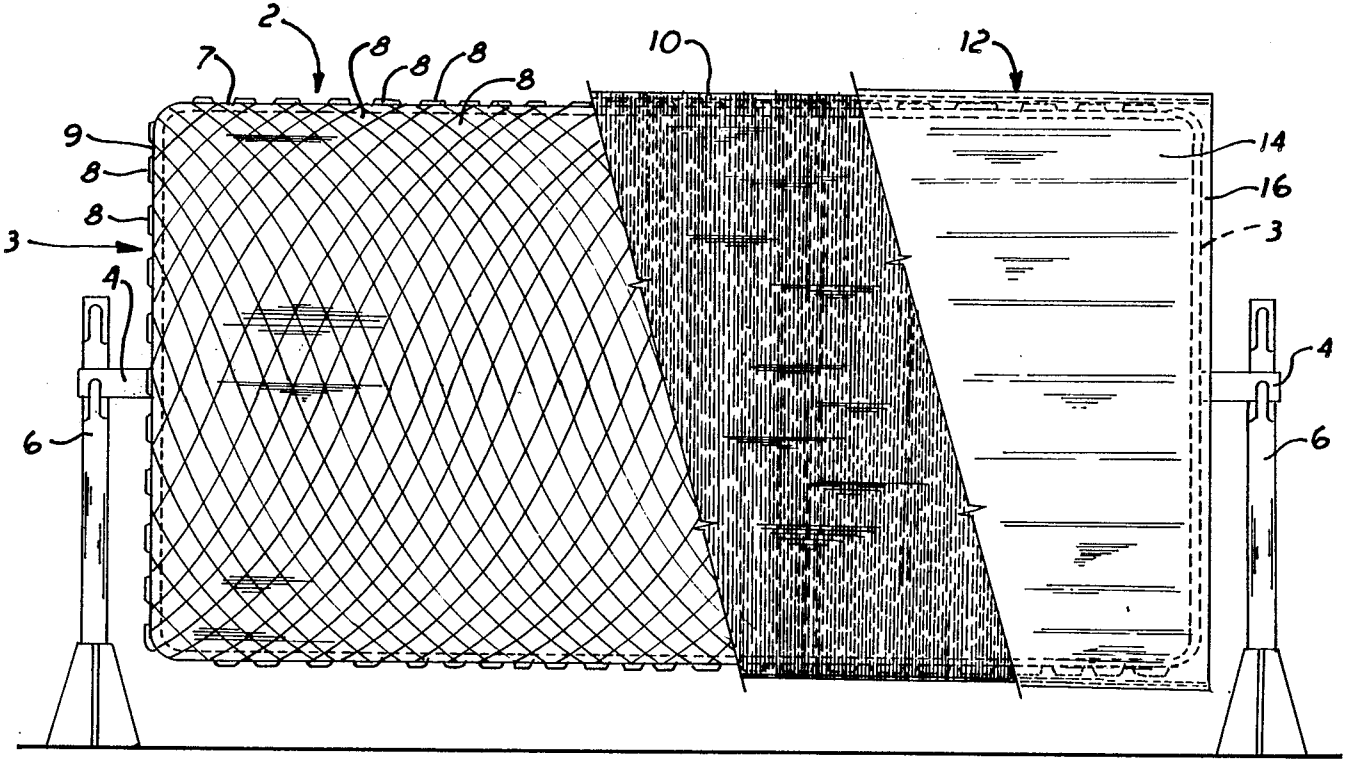
FIG. 1 is a side elevation, partially in section, of a tank according to the present invention, illustrating the various steps in the fabrication process.

A preferred embodiment of the apparatus of this invention is illustrated in the figures. FIG. 1 is a side elevational view, illustrating the manner of making the completed tank assembly by the application of the various materials to the inner storage tank.

While various forms and shapes of tanks may be utilized in practicing this invention, the most common shape utilized for underground storage is that of a cylinder, generally a right circular cylinder, having closed end portions. For simplicity of illustration this configuration of tank is utilized for illustrating the preferred embodiment of the invention. While the tank may be formed of any suitable material, preferably it is formed of steel for desirable characteristics of strength and rigidity. To simplify subsequent steps, it is preferred but not required that a spindle 4 be attached, such as by welding, to the center of each tank head or end portion, collinear with the axis of the tank. As shown in FIG. 1, these spindles 4, and thus the inner tank 2, may then be supported off the ground on conventional uprights 6. This provides for convenient rotation of the tank about its axis for purposes to be set forth below.

Figure 4:
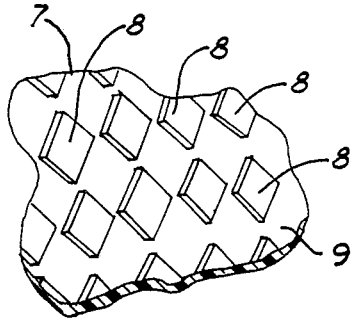
FIG. 4 is a fragmentary view on a substantially enlarged scale of a segment of the inner tank illustrating the pattern of projection extending outwardly from the exterior thereof.

The tank preferably is formed of metal panels 7, suitably shaped and formed and then fastened together by conventional means, such as welding. As shown on FIG. 1 and on the enlarged fragmentary view of FIG. 4, the metal, such as panel 7, from which the inner tank is formed has a pattern of projections 8 extending outwardly from a base surface 9 on at least one side thereof, such that the exterior surfaces of the inner tank 2 include the projections 8 extending outwardly from the base surface 9 thereof. While it is preferable to form the entire surface of the inner tank from such patterned metal, the invention could also be practiced by forming principally the lower portions of the tank from such patterned metal.

The exterior sheath of the tank of this invention may be fabricated in a number of different ways. On advantageous method comprises the wrapping of the exterior cylindrical walls of the tank with a sheet, web, or film of imperforate material, such as a stretched sheet 10 of synthetic resin, such as polyethylene film or the like. This sheet or film is stretched over the exterior surfaces of the inner tank 2 as the tank is rotated on its spindles 4. The sheet 10 stretched over the tank 2 will be supported by the projections 8 away from the base surface 9 of the exterior of the tank 2. Such a sheet preferably is also stretched over the end portions 3 of the inner tank 2 to space subsequent material used in forming the outer sheath from the base surface 9 of those end portions. Various other materials could likewise be substituted in place of the stretched sheet to support the subsequent layers of this sheath. Additionally, with appropriate selection of materials used in fabricating the sheath, such as preimpregnated glass fiber mat that will be supported on the projections 8, it is also possible to dispense with use of this stretched sheet 10 completely.

In this preferred embodiment the rigid outer sheath 12, and particularly the cylindrical sidewall portions 14 thereof are formed by bonding resin impregnated glass fiber mats to the sheet 10 in a conventional manner. It has been found convenient to lay sections of such glass fiber matting over the film-wrapped inner tank and then apply suitable and well known resins to that matting, although matting that is preimpregnated with resin could be used with equal facility. An alternative and even faster approach to manufacture of such a tank is by spraying chopped, resin impregnated glass fiber directly onto the sheet 10 by what is known as a "chopper gun." While the thickness of the outer sheath 12 may vary according to the severity of conditions anticipated, it should be of sufficient thickness to provide a substantially rigid sheath. It has been found that one-quarter inch thickness of the cured, resin impregnated glass fiber generally provides sufficient strength and rigidity for the sheath.

To form the end portions 16 of the sheath 12, the resin impregnated glass fiber mat may simply be laid and wrapped around the tank end portion 3, forming a continuous structure with the cylindrical sidewalls. If this technique is used, the sheet or film 10 may either be continued over those end portions 3 or may be omitted from the end portions. If it is omitted, it is preferable to coat the end portions of the tank with a release agent to prevent the resin from bonding to the end portions of the tank 2. This continuous application of the glass fiber material may be effected with the tank still supported by the spindles 4, or with those spindles cut off. If the spindles are retained, they may be cut off at a later time and a patch applied over the hole left by the spindle. This continuous layup method of forming the end portion 16 of the sheath 12 is also illustrated in the partial sectional view of FIG. 3.

Figure 6:
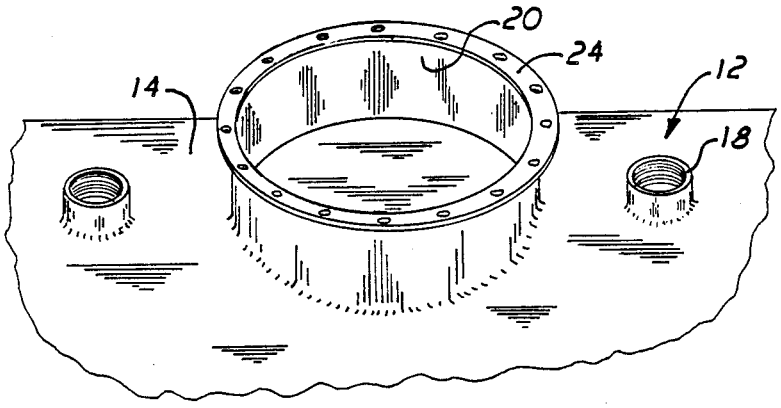
FIG. 6 is a perspective view of the apparatus of FIG. 5 illustrating the completed installation of a port and of plumbing connections.

The remaining steps involved in the manufacture of the double wall tank of this invention may depend upon the nature of the inner tank 2 used in manufacturing the product. If the tank 2 is a previously used unit, or one that already incorporates a manhole or other aperture for access to the interior, such as element 20 shown in FIGS. 2 and 6, and may also include other plumbing connections, the application of the exterior sheath 12 is preferably done in a manner that bonds around those fittings and apertures while providing for access to them. With this situation little additional work may be necessary to complete the manufacture of the product of this invention.

Figure 5:
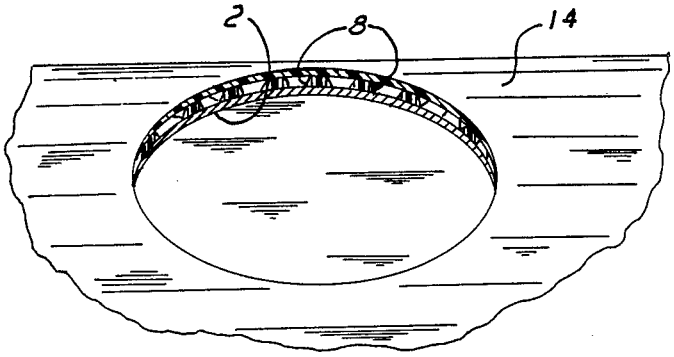
FIG. 5 is a fragmentary upper perspective view of the tank of FIG. 1 illustrating the cutting of an aperture through the tank wall in the outer sheaths.

If the inner tank 2 from which this article is manufactured is a new tank, or a remanufactured one in which there exists no apertures or fittings, it is easiest to apply the sheath 12 around these cylindrical sidewalls in a continuous manner. Then, to form the necessary opening into the interior of the tank, appropriate holes may then be cut by any suitable means, such as a hole saw or the like. In most tanks it is desirable to provide access to the interior that is large enough for entry of a person into the tank. This may be done by forming an aperture, as by cutting, through the outer sheath 12, the spacing material 8 and a portion of the cylindrical sidewall of the inner tank 2, as shown in FIG. 5. Then, preferably from inside the tank, a hollow cylindrical member 20, preferably having a shape and size corresponding generally to the shape and size of the aperture cut, is sealingly joined to the cylindrical sidewall of the tank 2 suitably by welding the joint adjacent the periphery of the aperture to the inner tank 2. This then provides the necessary manhole. Additional holes may be cut through the sheath 12 and inner tank 2 for insertion and attachment, suitably by welding, of additional fittings such as for introduction and withdrawal of liquid from the tank. When all of these fittings have been affixed to the tank, the portions of the sheath 12 adjacent those various fittings may then be bonded thereto with appropriate resin, to yield a finished structure as shown in the fragmentary perspective view of FIG. 6.

Figure 3:
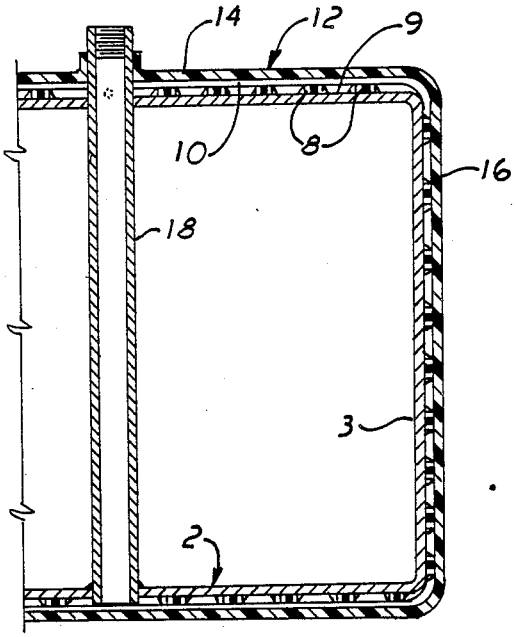
FIG. 3 is a partial side sectional view taken along line 3–3 of FIG. 2.

A suitable coverplate 22 may be provided for the cylindrical member 20 as shown in FIG. 3. This coverplate may conventionally be secured to the upper flange 24 of that cylindrical member 20 by conventional means, such as a plurality of bolts 26 extending through the coverplate 22 and the flange 24. In this coverplate may be provided such items as a lifting ring 28 and conventional fittings 30 and 32 to provide for insertion of appropriate plumbing to facilitate introduction and withdrawal of liquids to be stored within the completed tank.

Figure 2:
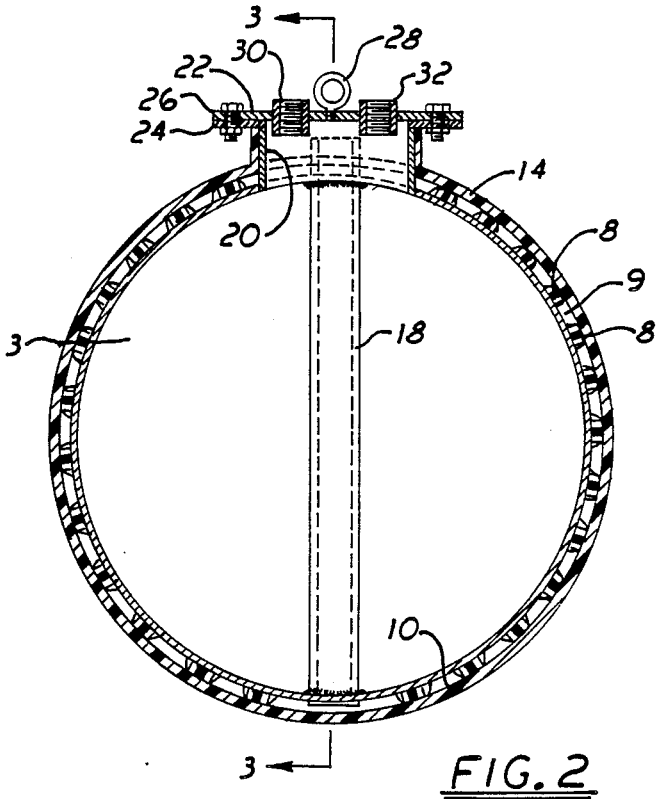
FIG. 2 is an end sectional view of a completed tank according to FIG. 1.

An arrangement for positioning a tube 18 for use in detecting the presence of liquid in the space between the inner tank 2 and sheath 12 is illustrated in FIGS. 2 and 3. In this embodiment, the tube 18 extends through the tank itself. This tube 18 may be installed by providing an aperture through the cylindrical sidewall of the outer sheath 12 and film 10, through the adjacent upper portion of the inner tank 2 and then through the diametrically opposed lowermost portion of the inner tank 2. Thus, the tube may be inserted through the outer sheath aperture and extend through the tank and through the aperture in the lowermost portion thereof, so that the lower portion of tube 18 is adjacent the lower portion of the space between the inner tank 2 and sheath 12. The joints between the tube 18 and the outer sheath 12 of the inner tank 2 are sealed liquid-tight in a conventional manner. In the structure of FIG. 3 the tube 18 provides the means within the space between the inner tank exterior surface and the outer sheath inner surface for detecting the presence of liquids within that space and for withdrawing such liquid, if desired.

On completion of the manufacturing steps set forth above both the inner tank 2 and its sheath 12 may have pressure applied to them, as by compressed air. With the apparatus illustrated in FIG. 3 the application of pressure through the tube 18 will not only permit the testing of the sheath 12 for any leakage but also will permit the testing of the tank 2 to ascertain if there is any leakage of that pressurized air from the space between the sheath 12 and the inner tank 2 into that inner tank 2. Such application of pressure will also serve to pop free any portion of the end caps 16 that may have stuck to the release agent applied to the end portions 3 of the inner tank 2, in order to permit the passage of liquids along the exterior surface of the end portions 3 of the inner tank 2.

By the foregoing construction there is thus provided a double wall tank that can be manufactured economically. This structure provides an exterior sheath, which may be formed from a material that is free of any tendency to rust or corrode, and which is spaced from the inner tank to permit the collection within that space and thus detection of any liquids leaking into that space, either from the tank or from sources exterior to the sheath. Thus may be determined the existence of any leakage of either the tank or the sheath by simply detecting the presence and nature of any liquid present in that space. By the use of a relatively thick and rigid outer sheath, the strength of that sheath is enhanced over similar structures that may use flexible outer covering. Furthermore, such a rigid external sheath permits testing of the integrity of the sheath and tank at substantial pressures, which could not be done with a flexible covering without danger of rupture.

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed is:

1. A method of manufacturing a double wall storage tank for storage of liquids, comprising the steps of forming a substantially rigid inner tank from metal with at least lower portions of said inner tank being formed from patterned metal having a pattern of projections formed of said metal and extending outwardly from a base surface on at least one side thereof, such that the exterior surfaces of said portions of said inner tank include said projections extending outwardly therefrom;

stretching over said inner tank and said projections a sheet of imperforate material to separate said inner tank from subsequently applied sheathing material; and applying over said inner tank exterior and said sheet a substantially rigid outer sheath of a material that is substantially liquidtight, said sheath being spaced from said inner tank exterior surface by said sheet supported on said projections, whereby is provided a rigid, double wall tank.

2. The method of claim 1 wherein said sheath comprises at least one layer of fibrous material coated with a curable resin which, upon curing, provides a coating that is resistant to passage of water or hydrocarbon liquids.

3. The method of claim 2 wherein said fibrous mat comprises a mat a glass fibers.

4. The method of claim 3 wherein said inner tank includes at least one aperture through a wall thereof for providing access to the interior of said inner tank, and wherein said sheath is applied in such a manner that the completed tank retains access to the interior thereof through said aperture.

5. The method of claim 1 wherein said inner tank has the configuration generally of a cylinder with closed ends and wherein said projections extend outwardly from the exterior surface of the cylindrical wall thereof, whereby the projections and overlying imperforate sheet will service to space the outer sheath radially from the base surface of the cylindrical wall of the inner tank, with the sheath being of generally cylindrical form with cylindrical wall portions and closed in portions.

6. The method of claim 1 further comprising the step of forming an aperture through said sheath, said sheet and a portion of a wall of said inner tank, whereby is provided access to the interior of said inner tank.

7. The method of claim 6 further comprising the step of sealingly joining to said wall of said inner tank adjacent the periphery of said aperture therethrough a hollow cylindrical member having a cylindrical shape and size corresponding generally to the shape and size of said inner tank aperture and sealingly joining said outer sheath to said hollow cylindrical member.

8. The method of claim 1 further comprising the steps of providing apertures through the upper portions of said outer sheath and said inner tank and through a lower portion of said inner tank, the insertion of tube means through said aperture and extending between a point exterior to said outer sheath and said inner tank and a portion adjacent a lower portion of the inner surface of said outer sheath, and the forming of liquid-tight joints between said tube means and the peripheries of said apertures, whereby any liquid within the space between the inner tank and the outer sheath may be contacted by and withdrawn through the tube means.

9. A tank for storage of liquids comprising a substantially rigid inner tank having means for introducing thereinto and withdrawing therefrom liquids to be stored, said inner tank being formed from metal with at least lower portions of said inner tank being formed from patterned metal having a pattern of projections formed in said metal extending outwardly from a base surface on the exterior of said portions of said inner tank;

a sheet of imperforate material stretched over said inner tank exterior surface and said pattern of projections extending outwardly from the base surface thereof; and a substantially rigid outer sheath formed over said inner tank and said sheet of imperforate material, said outer sheath being formed of a resin impregnated fibrous material that is substantially liquid-tight, whereby is formed an outer sheath enclosing the inner tank and being spaced from the base surface of the exterior of the inner tank by the sheet of imperforate material and the pattern of projections.

10. A tank according to claim 9 further comprising means located within the space between said inner tank exterior surface and said outer sheath inner surface for detecting the presence of liquid within that space.

11. A tank according to claim 10 wherein said liquid detecting means comprises tube means extending from the outside said tank to a point adjacent said lower portions of said outer sheath inner surface, whereby any liquid introduced between the inner tank exterior surface and the outer sheath inner surface may be drawn into that tube.

12. A tank according to claim 11 wherein said tube means extends through the upper portions of said sheath and the side wall of said inner tank, through the interior of said tank and through a lower portion of said inner tank side wall, whereby a sensing device may be inserted through the tube means to sense the presence of liquid between the lower portion of the inner tank and the outer sheath.

* * * * *